US005215624A

United States Patent [19]

Dastolfo, Jr. et al.

[11] Patent Number: 5,215,624

[45] Date of Patent: * Jun. 1, 1993

[54] MILLING SOLUTION AND METHOD

[75] Inventors: LeRoy E. Dastolfo, Jr., Lower Burrell; Gary P. Tarcy, Plum Boro, both of Pa.

[73] Assignee: Aluminum Company of America, Pittsburgh, Pa.

[ * ] Notice: The portion of the term of this patent subsequent to Mar. 31, 2009 has been disclaimed.

[21] Appl. No.: 807,725

[22] Filed: Dec. 16, 1991

Related U.S. Application Data

[63] Continuation-in-part of Ser. No. 652,587, Feb. 8, 1991, Pat. No. 5,100,500.

[51] Int. Cl.[5] ..... B44C 1/22; C23F 1/00; C09K 13/04; C09K 13/08

[52] U.S. Cl. ..... 156/637; 156/654; 156/659.1; 156/664; 252/79.2; 252/79.3

[58] Field of Search ..... 156/637, 639, 654, 656, 156/659.1, 664; 252/79.2, 79.3, 79.4, 142; 134/2, 3, 28, 40, 41

[56] References Cited

U.S. PATENT DOCUMENTS 4,900,398 2/1990 Chen ..... 156/644
5,100,500 3/1992 Dastolfo et al. ..... 156/637

*Primary Examiner*—William A. Powell
*Attorney, Agent, or Firm*—Gary P. Topolosky; Glenn E. Klepac

[57] ABSTRACT

A substantially nitrate-free solution for milling products of refractory metals, especially titanium, which solution contains: (a) about 5–100 g/l of ammonium bifluoride; (b) up to about 90 g/l of hydrochloric acid; (c) a hydrogen inhibitor which may be either sodium chlorate or ammonium peroxysulfate; and (d) a balance of water and impurities. There is further disclosed a method for chemically milling, etching and/or pickling metal products, such as titanium alloy forgings, with the aforementioned solution.

20 Claims, No Drawings

MILLING SOLUTION AND METHOD

This is a continuation-in-part of U.S. application Ser. No. 07/652,587, filed on Feb. 8, 1991, U.S. Pat. No. 5,100,500 the disclosure of which is fully incorporated by reference herein.

BACKGROUND OF THE INVENTION

1. Field of the Invention

This invention relates to an improved chemical milling solution and method for milling, etching or pickling metal products therewith. More particularly, the invention relates to a bath composition and method for milling or pickling titanium workpieces, such as forgings or the like.

2. Technology Review

As used herein, the term "milling" shall mean the selective and controlled removal (or corrosion) of metal (or metal oxides) from a part or object by chemical milling, etching and/or pickling. Most milling procedures form metal product of a desired thickness and/or configuration by removing metal from treated workpieces and imparting greater weight savings to aerospace parts or the like. Milling operations are typically performed after particular metal parts have been formed by casting, forging, extrusion or rolling, then heat treated. Milling is also used to make shapes which cannot otherwise be machined by conventional chip-making techniques, or which can only be machined by known methods at unreasonably high cost. For many parts, masking of certain areas is done to prevent their exposure to a corrosive milling solution.

As used for the description of this invention, "milling" shall also include metal etching, the controlled removal of metal for dimensional and shape control, and metal cleaning or pickling, i.e., the removal of embrittled oxidized surfaces. For titanium alloys, oxidized surfaces are sometimes referred to as alpha-case. Such surfaces typically result from elevated temperature exposure in the manufacturing process, i.e., casting, rolling, extrusion, forging or the like.

Any chemically-dissolvable metal may be subjected to treatment by the aforementioned milling practices. Alloys of aluminum, beryllium, magnesium, titanium and various steels are the most commonly milled metal products. Refractory metals such as molybdenum, tungsten, niobium (columbium) and zirconium may also be chemically etched in a similar manner. The workpieces treated by milling (i.e. chemical, etching and/or pickling) need not be limited in size, provided a large enough bath of solution can be maintained. Milled parts may be cast, forged, extruded or rolled. Their end shapes may be flat, tubular or in any of the complex configurations required by today's manufacturers of aerospace and other parts.

The first chemical milling practices are believed to have occurred around 2500 B.C., when ancient Egyptians used citric acid to etch copper jewelry. Current industrial milling practices can be traced back to the methods set forth in Sanz U.S. Pat. No. 2,739,047. Numerous evolutions to milling solutions have occurred since modern milling procedures were patented over 35 years ago. Many of these solution developments depended on the particular metal alloy being milled.

High carbon chromium steel may be chemically etched in a solution containing 300–500 ml/1 HCl; 50–150 ml/1 $HNO_3$; 20–40 g/l $NaNO_3$; 10–30 g/1 ammonium persulfate and 20–50 ml/1 $H_2O_2$ according to Russian Patent No. 505,750.

Aluminum foil is cleaned with a water solution comprising 1–5% ammonium persulfate, 1–5% sodium chlorate and 1–3% of a surfactant selected from dioctyl sodium sulfosuccinate and dodecyl benzene sulfonate in Flowers U.S. Pat. No. 3,954,498. Russell et al U.S. Pat. No. 4,337,114 dissolves nodular copper from aluminum foil surfaces using a 0.1–2.0M solution of ammonium persulfate.

In Hanazono et al U.S. Pat. No. 3,905,883, thin films of permalloy, iron, nickel, cobalt and copper are etched with an electrolyte comprising 0.1–2.5 mol/1 ammonium persulfate and 0.02–10 mol/1 nitric acid.

Copper etching presents a different set of problems. Matsumoto et al U.S. Pat. No. 3,936,332, for instance, teaches etching copper with a solution containing at least 5% by weight peroxysulfate, at least 50 parts per million (ppm) of a diazine compound and from 5 to 2000 ppm of a halogen compound selected from: HF; HBr; HCl; salts thereof; oxides of Fl, Cl, Br and I; and oxygen-containing acids of Cl, Br and I; among other possibilities. In Matsumoto et al U.S. Pat. No. 3,939,089, copper is etched with a solution of peroxysulfate, purine and a halogen. Pryor et al U.S. Pat. No. 4,725,374 etches copper with a solution of 0.5–6.0 N peroxydisulfuric acid and 10–500 ppm chloride or fluoride. A process for etching copper with substantially the same solution(s) as above is claimed in related Pryor et al U.S. Pat. No. 4,973,380.

For titanium and titanium-based alloys, Chen U.S. Pat. No. 4,900,398 claims a milling method which uses an aqueous solution consisting essentially of 1–5% hydrofluoric acid, 1.5–4% chlorate ion and, optionally, up to 20% of an acid selected from the group consisting of $H_2SO_4$, HCl and $HO_3$.

Kremer et al. U.S. Pat. No. 4,314,876 discloses a milling solution consisting essentially of: 3–10 wt.% ammonium bifluoride; 5–15 wt.% nitric acid, or its equivalent as ammonium nitrate, sodium nitrate or potassium nitrate; 2–25 wt.% hydrochloric acid when ammonium nitrate, sodium nitrate or potassium nitrate is used as the nitrate source; up to 1 wt.% wetting agent; and 92–49 wt.% water. According to the examples, this solution removes Ti metal at rates ranging from 0.000027 to 0.00074 mils/side/minute.

In Coggins et al. U.S. Pat. No. 4,116,755, there is claimed a method and composition for milling titanium without excessive hydrogen absorption. The composition comprises, per liter of solution: 126–700 grams of pure nitric acid or its equivalent; the equivalent of 8.8–176.1 grams of pure hydrofluoric acid; at least 10 grams of a carbonic acid derivative; and at least 1.5 grams of a monocarboxylic acid derivative containing alkali metal ions.

Coggins et al. U.S. Pat. No. 3,944,496 claims a milling composition for titanium and other refractory metals which comprises: 210–630 grams of pure nitric acid; 98–440 grams of pure phosphoric acid or its equivalent; 61–88 grams of pure hydrofluoric acid, or its fluoride-producing equivalent; and a carbonic acid derivative equivalent to 15 grams or more of carbamide.

In Roni U.S. Pat. No. 3,844,859, an improved method for milling titanium includes immersing metal in an aqueous fluid containing: a sufficient amount of hydrofluoric acid for effecting an etch rate of 4–15 mils/side/-minute; a sufficient amount of dodecylbenzene sulfonic acid and linear alkyl sulfonic acid for keeping the surface tension of this fluid between 28–60 dynes/cm; and 0.2–1.2 wt.% nitric acid. Between 0.07 and 2.9 wt.% ammonium bifluoride may be added to this solution for reducing channeling and ridging in the fillet areas of a vertically-milled part.

Gumbelevicius U.S. Pat. No. 3,788,914 employs a titanium milling solution which contains, per liter of solution: 126–682 grams of nitric acid; the equivalent of 8.8–176.1 grams of pure hydrofluoric acid; and at least 10 grams of a carbonic acid derivative selected from carbamide, urea nitrate, urea oxalate and semi-carbazide.

Kreml U.S. Pat. No. 3,666,580 discloses a milling solution comprising 2–10 vol.% hydrofluoric acid and 1–10 vol.% hydrochloric acid, with a remainder of water. This solution is maintained at a temperature between 65°–140° F. for the milling of titanium metal parts therein.

The milling composition of Snyder et al. U.S. Pat. No. 2,981,610 contains: 0.1–4.7 molar nitrate; 0.1–2.2 molar chloride; 0.25–5.3 molar fluoride; at least 0.22 normal acetate; and a hydrogen ion concentration of 2.8–10.7 molar.

Russian Patent No. 1,294,872 removes oxide film from the surface of titanium articles by etching them for 20–25 minutes in molten ammonium persulfate heated to 300°–340° C., washing the articles with water, holding them for 3–5 minutes in a 30–40% solution of H2S04 heated to 60°–70° C., followed by water washing and air drying.

Current practices for chemically milling, etching and pickling titanium workpieces employ baths of hydrofluoric acid and nitric acid in various concentrations. Hydrofluoric acid poses risks to the health of its day-to-day handlers, however. Any process employing HF poses yet another major risk in the event said additive is accidentally released into the environment. Hydrofluoric acid is being considered for greater Federal regulation because of such concerns. Nitric acids, on the other hand, release visible fumes of toxic $NO_x$ during standard milling operations. Emission source locations are also under increasing regulatory pressure to reduce or eliminate such toxins from the workplace. Although hydrofluosilicic acid ($H_2SiF_6$) has been proposed as an HF substitute, this liquid is also hazardous and quite volatile.

BRIEF DESCRIPTION OF THE INVENTION

It is a principal objective of this invention to provide a milling solution and method which eliminates the use of hydrofluoric acid. It is another objective to provide a bath composition for chemically milling, etching and/or pickling metal workpieces, which composition eliminates the need for using $HNO_3$ or any derivatives thereof. This invention represents a significant environmental advance over the art by using a substantially nitrate-free solution for milling titanium and other metal parts.

It is another objective to provide a milling method which produces commercially acceptable metal removal rates of about 0.25 mils/side/minute or higher. It is another objective to provide means for chemically milling titanium and other refractory metals at moderate operating temperatures. It is yet another objective to provide a pickling method whose bath removes embrittled or oxidized surfaces from titanium and other metals at a commercially acceptable rate.

It is another principal objective to provide a milling formula which reduces the amount of hydrogen gas absorbed onto the metal surface being milled, especially for those embodiments adding at least some $H_2O_2$, $NaClO_3$ or $(NH_4)_2S_2O_8$ to the milling bath. This invention decreases the negative impact of hydrogen absorption on metal embrittlement and other metal properties. It achieves reduced hydrogen absorption without resorting to such suppressor additives as nitric acid or chromic acid.

It is yet another objective to provide improved means for milling (i.e., chemically milling, etching and/or pickling) titanium alloys, especially alpha, alpha-beta and beta phase titanium alloys such as Ti-6Al-4V, Ti-6Al-6V-2Sn, Ti-10V-2Fe-3Al and others, which method overcomes the disadvantages of the prior art referred to above.

In accordance with the foregoing objects and advantages, this invention provides a substantially nitrate-free solution for milling metal products, especially titanium and titanium alloy workpieces. The solution comprises: (a) about 5–100 g/1 of ammonium bifluoride; (b) up to about 90 g/1 of hydrochloric acid (or about 200 ml/1 of 36.5 wt.% HCl or its equivalent); and (c) a balance of water and impurities. Preferred embodiments consist essentially of about 15–75 g/1 of $NH_4HF_2$ and about 8–70 g/1 HCl (or 20–160 ml/1 of the 36.5 wt.% HCl). An alternative embodiment adds up to about 170 g/1 of pure hydrogen peroxide (or about 500 ml/1 of 30 wt.% $H_2O_2$), to the solution for reducing the amount of hydrogen absorbed by titanium workpieces during the milling process. Still other alternatives substitute salts of chlorate or peroxysulfate for the latter hydrogen inhibitor. There is further disclosed a method for chemically milling, etching and/or pickling such metal products as Ti-6Al-4V, Ti-6Al-6V-2SN, Ti-10V-2Fe-3Al and other alloy forgings, with the aforementioned solutions.

DETAILED DESCRIPTION OF PREFERRED EMBODIMENTS

As used herein, the term "substantially nitrate-free" shall mean that the milling solution of this invention contains no nitrate ions, in any form, by way of positive addition to the other solution components. Since mixing conditions and component integrities are not always perfect, however, trace amounts (i.e., less than about 1 wt.%) of nitrates or nitrate-forming compounds may find their way into solution, even by way of contamination from the numerous metal surfaces being treated with milling baths of this sort. Such inadvertent additions are meant to be covered by the term "impurities" that accompanies the water remainder to this aqueous mill stream.

With respect to the claimed concentration of hydrochloric acid and hydrogen peroxide added to various embodiments of this invention, commercial suppliers of hydrochloric acid make such products available in concentrations of 32 or 36.5 wt.% HCl by way of dilution. Hydrogen peroxide is likewise packaged in concentrations of about 30 to 70 wt.% $H_2O_2$. It is to be understood that equivalents of such components should be determined based on the concentrations set forth in accordance with the invention described hereinabove.

Repeated references are made throughout this description to the milling of a titanium-based alloy referred to as Ti-6Al-4V. This alloy generally contains about 6 wt.% aluminum and about 4 wt.% vanadium with a remainder of titanium. It is characterized by good corrosion resistance, elevated temperature strength and stability as well as good machinability. The alloy is typically sold in bar, sheet, strip, wire, extruded shape and tubing forms. It also lends itself well to the production of a variety of forging shapes. The invention is not intended to be limited to this particular alpha-beta phase titanium alloy, however. Another representative alloy with both alpha and beta phases contains about 6% aluminum, about 2% tin, about 4% zirconium, about 2% molybdenum and a remainder of titanium (Ti-6Al-2Sn-4Zr-2Mo). When hardened by aging treatment, this alloy exhibits even tensile strengths comparable to that of Ti-6Al-4V. It is best suited for applications where heavy stresses are imparted for long periods of time at high temperatures. The alloy possesses good strength, toughness and stability at temperatures up to about 482° C (900° F). Another alloy possessing particularly good welding characteristics and fabricability, with somewhat improved tensile strength, is a titanium-based alloy containing about 6% aluminum, about 6% vanadium and about 2% tin (or Ti-6Al-6V-2Sn).

The milling method and composition of this invention may also be used with other titanium-based alloys, such as commercially pure titanium metal (i.e., at least about 99.3 wt.% pure) and those alloys containing only alpha phases, only beta phases (such as Ti-10V-2Fe-3Al), and those containing an alpha-2 phase or gamma phase. Titanium alloys with a beta phase, alone or in combination with an alpha phase, are generally more difficult to chemically mill due to the high affinity of beta and some alpha-beta alloys for hydrogen.

Titanium-based alloys are particularly useful for aerospace applications, including airframe and engine parts, due to their light weight, high strength and thermal stability. Such parts are frequently machined by milling to thin cross sections. Milling also produces very smooth outer surface finishes on these products.

Hydrogen absorption onto the surfaces of the metal being milled may impart an internal stress on the metal workpiece. Such stresses may cause these metal parts to crack prematurely. With some metals, including titanium, hydrogen absorption in sufficient quantities causes undesirable metal hydrides to form. In the industry, excessive hydrogen absorption is commonly referred to as "hydrogen embrittlement". It is a principal objective of this invention to minimize the amount of hydrogen absorbed into a surface treated with the aforementioned milling solutions. For titanium metal alloys, the degree of hydrogen absorbed is generally proportional to the amount of beta-phase present and surface area to volume ratio of the workpiece being milled. Hydrogen contents of a milled article are typically measured in parts per million (ppm). Most aeronautical specifications for titanium alloys permit maximum hydrogen absorption concentrations of about 150–200 ppm, depending upon the particular alloy involved. Such applications are generally more conservative with respect to amounts of $H_2$ absorbed, however. For some non-aerospace uses of titanium workpieces, higher $H_2$ concentrations, up to about 500 ppm, may be tolerated.

The ammonium bifluoride-hydrogen chloride milling solution of this invention has been found to produce acceptably low levels of hydrogen pickup in many alloys, such as Ti-6Al-4V, while avoiding the need to add such typical hydrogen suppressants as nitric acid or chromic acid ($CrO_3$) For some titanium alloys, it may be beneficial to add up to about 170 g/l of hydrogen peroxide to the bath. This was the case with Ti-10V-2Fe-3Al where minor additions of $H_2O_2$ reduced hydrogen pickup by as much as 60%. It is believed that $H_2O_2$, like nitric or chromic acid, provides an oxide layer on the metal surface being milled. This layer tempers the action of $NH_4HF_2$ while providing some barrier for hydrogen diffusion into the metal surface being milled. Unlike $HNO_3$, hydrogen peroxide does not emit toxic fumes. Nor does it contain such toxic ions as hexavalent chromium. The same can be said for the alternative embodiments using chlorate and peroxysulfate ions. On a preferred basis, at least about 30 g/l of $NaClO_3$ or at least about 180 g/l of $(NH_4)_2S_2O_8$ may be combined with a hydrochloric acid-ammonium bifluoride based milling solution to produce lower hydrogen pickup values. On a more preferred basis, about 40–650 g/l of sodium chlorate or about 200–650 g/l of ammonium peroxysulfate is added to the foregoing solutions for hydrogen inhibition. Still other chlorate salts, such as $KClO_3$ or $NH_4ClO_3$, may be substituted for $NaClO_3$ on a less preferred basis. $K_2S_2O_8$ or $Na_2S_2O_8$ may also be substituted, in different concentrations, for the preferred peroxysulfate ions specified above.

The bath composition and method of this invention may be used to mill, etch and/or pickle alloys other than titanium. Transition metals such as zirconium, and refractory metals such as niobium (columbium), molybdenum, tungsten and/or tantalum may be milled with these same solutions.

In the typical milling of a titanium alloy product, such product should first be cleaned with trichloroethylene, or another known cleaner, before exposure to a milling bath of this invention. Cleaning serves to remove any surface contaminants, such as grease, oil, etc., which may remain from the metal part fabrication or other pre-treatment steps. Cleaning also reduces contamination of the milling bath while providing a clean surface for better adhesion of any masks applied to the product surface.

Depending upon the final product size and shape, it may be necessary to mask portions of the workpiece being milled by any known or subsequently-developed means. One representative masking means is referred to as photoresistive masking. Another method dips the areas to be masked in a neoprene-based maskant such as the version commonly supplied by Turco Company Products, Inc. In some instances, product specimens are repeatedly dipped into one or more vats of milling solution. In other cases, the solution into which titanium alloy products are dipped may be agitated by means of air agitation, an electric stirrer or continuous circulation pump. Such means serve to flow solution continuously over the metal part being milled so that a layer of relatively fresh bath contacts with the surface being milled. This helps the invention achieve a substantially uniform rate of milling or etching, usually on the order of about 0.5–1.5 mils/side/minute.

In the pickling of titanium alloy products to remove an embrittled, oxide surface (or alpha case layer) therefrom, it is preferred that such products be cleaned before being exposed to the milling baths of this invention. Such cleaning may be performed chemically by exposing product to a salt bath or the like, or by using any mechanical scale removal technique known to those skilled in this art. It tends to remove scale, lubricants and other contaminants from the product surface which might otherwise impede or hinder pickling according to the invention.

Preferred embodiments of this invention maintain the milling bath at a slightly elevated temperature, usually between about 21°-71° C. (70°-160° F.), and more preferably between about 32°-57° C. (90°-135° F.). It is believed that such temperatures enhance metal removal rates while not imposing undue bath handling hardships.

The following examples are provided by way of illustration. They are not intended to limit the scope of this invention in any manner, however. About 2500 ml of milling solution was prepared for each example. In the solution of Example 1, a 5.913 g specimen of Ti-6Al-4V having an average thickness of 0.104 inch was immersed, unmasked and with both sides exposed, while the solution was continuously stirred. About 2 g/1 of titanium sponge was also inserted into each bath (except for those of Table 4) for conditioning the bath and providing a consistent starting titanium concentration therein. After 20 minutes in the bath, each specimen was removed, rinsed with a nitric acid solution, dried, weighed and measured. Similarly-sized specimens were then subjected to the same procedures for the respective variables and constants described for Tables 1 through 4. For the data of Tables 5 through 8, samples of Ti-10V-2Fe-3Al were milled with a solution to which $H_2O_2$, $NaClO_3$ or $(NH)_2S_2O_8$ was purposefully added.

EXAMPLES 1-6

For the following data, the concentration of $NH_4HF_2$ in each solution was kept constant, at 34.2 g/1 (0.6 M), and the bath temperature was kept at 66° C. (151° F.) while various amounts of HCl were added for determining the effect of HCl concentration on milling rate and post-milling hydrogen content. All milling rates reported hereinbelow were calculated from the differences in average specimen thicknesses and total exposure times.

TABLE 1

| Ex. | 36.5 wt. % HCl ml/1 (M) | Milling Rate mils/min/side | Hydrogen Content After Milling ppm |
|---|---|---|---|
| 1 | 0 (0) | 0.268 | 42 |
| 2 | 24.8 (0.3) | 0.548 | 35 |
| 3 | 49.6 (0.6) | 0.750 | 39 |
| 4 | 78.0 (0.94) | 1.001 | 30 |
| 5 | 99.2 (1.2) | 1.275 | 20 |
| 6 | 148.8 (1.8) | 1.250 | 36 |

EXAMPLES 7-10

For the following data, hydrochloric acid concentrations of the present solution were kept constant at 99.2 ml/1 (or 1.2 M) of 36.5 wt.% HCl, at a constant solution temperature of 66° C. (151° F.), for determining the effect of various $NH_4HF_2$ concentrations on milling rate and hydrogen absorption.

TABLE 2

| Ex. | $NH_4HF_2$ g/1 (M) | Milling Rate mils/min/side | Hydrogen Content After Milling ppm |
|---|---|---|---|
| 7 | 17.1 (0.3) | 0.475 | 43 |
| 8 | 34.2 (0.6) | 1.275 | 20 |
| 9 | 51.3 (0.9) | 1.450 | 31 |
| 10 | 68.4 (1.2) | 1.425 | 42 |

EXAMPLES 11-16

In the next six examples, milling temperatures were varied with a constant composition comprising 34.2 g/1 (or 0.6 M) of $NH_4HF_2$ and 99.2 ml/1 of 36.5 wt.% HCl (or 1.2 M).

TABLE 3

| Ex. | Temperature °F. | Milling Rate mils/min/side | Hydrogen Content After Milling ppm |
|---|---|---|---|
| 11 | 150 | 1.275 | 20 |
| 12 | 140 | 0.950 | 30 |
| 13 | 130 | 0.725 | 10 |
| 14 | 120 | 0.600 | 18 |
| 15 | 110 | 0.450 | 24 |
| 16 | 100 | 0.300 | 28 |

EXAMPLES 17-21

For the next set of data, milling temperatures were kept at 66° C. (151° F.) while the amount of Ti sponge added to the bath was varied. The respective concentrations of $NH_4HF_2$ and HCl were also varied in amounts sufficient to compensate for the excess Ti sponge above 2 g/1. Such compensations resulted in experimental solutions containing a constant amount of unreacted $NH_4HF_2$ and HCl with varying amounts of reaction by-products.

TABLE 4

| Ex. | $NH_4HF_2$ g/1 | (36.5 wt. %) HCl ml/1 | Ti Sponge g/1 | Milling Rate mils/min/side | Hydrogen Content After Milling ppm |
|---|---|---|---|---|---|
| 17 | 34.2 | 99.2 | 2 | 1.275 | 20 |
| 18 | 44.9 | 114.8 | 8 | 1.100 | 38 |
| 19 | 59.6 | 135.6 | 16 | 0.950 | 28 |
| 20 | 73.5 | 156.0 | 24 | 0.975 | 31 |
| 21 | 87.8 | 176.8 | 32 | 1.025 | 26 |

EXAMPLES 22-25

For the following data, solutions were prepared containing a constant concentration of 48 g/1 $NH_4HF_2$ (or 0.84 M) and 140 ml/1 of 36.5 wt.% HCl (or 1.69 M). Various amounts of $H_2O_2$ were then added to these solutions to determine their effect on milling rate and hydrogen absorption by specimens of Ti-10V-2Fe-3Al. For each run, the specimen was submerged for 20 minutes in a solution maintained at 54° C (130° F).

TABLE 5

| Ex. | 30 wt. % $H_2O_2$ ml/1 (M) | Milling Rate mils/min/side | Hydrogen Content After Milling ppm |
|---|---|---|---|
| 22 | 0 (0.00) | 0.9 | 217 |
| 23 | 43.2 (0.42) | 0.95 | 195 |
| 24 | 86.0 (0.84) | 1.325 | 150 |
| 25 | 172.0 (1.69) | 0.5 | 86 |

EXAMPLE 26

For this comparison, a solution was prepared containing 8 wt.% (or about 88 g/1) of $NH_4HF_2$, 12 wt.% of 36.5% HCl (or about 112 ml/1), and 85 wt.% of $NaNO_3$ (or about 94 g/1). A specimen of Ti-6Al-4V alloy was submerged in this solution and milled on both sides at 33°-42° C. (92°-108° F.) for 60 minutes. The weight of this specimen decreased from 15.440 to 15.406 grams while its thickness decreased from 0.204 to 0.201 inch. The milling rate of this solution to which nitrate was purposefully added was calculated at a much lower value of 0.025 mils/minute/side.

EXAMPLES 27-31

In these next five examples, reagent concentrations were kept constant at about 48 g/1 $NH_4HF_2$ and 140 ml/1 of 36.5% HCl (or 61.7 g/1 of pure HCl). Bath temperatures were kept at a constant 54° C. (130° F.). Various amounts of $NaClO_3$ were then added to these solutions for determining their effect on both milling rate and hydrogen content.

TABLE 6

| Ex. | $NaClO_3$ g/1 | Milling Rate mils/min/side | Hydrogen Content After Milling ppm |
|---|---|---|---|
| 27 | 0 | .675 | 356 |
| 28 | 6 | .775 | 328 |
| 29 | 20 | .825 | 293 |
| 30 | 40 | .425 | 86 |
| 31 | 60 | .300 | 52 |

EXAMPLES 32-36

For the next five examples, HCl concentrations were lowered to about 70 ml/1 of a 36.5 wt.% solution (or 30.9 g/1 of pure HCl). Sodium chlorate addition rates were then varied to determine their impact on milling rate and hydrogen content.

TABLE 7

| Ex. | $NaClO_3$ g/1 | Milling Rate mils/min/side | Hydrogen Content After Milling ppm |
|---|---|---|---|
| 32 | 0 | .406 | 465 |
| 33 | 6 | .550 | 440 |
| 34 | 20 | .650 | 353 |
| 35 | 40 | .350 | 81 |
| 36 | 60 | .100 | 30 |

EXAMPLES 37-42

In the last six examples, ammonium bifluoride concentrations were held constant at about 48 g/1. Hydrochloric acid levels were maintained at about 140 ml/1 of a 36.5% solution (or 61.7 g/1 of pure HCl), the same levels as in Examples 27-31. Ammonium peroxysulfate concentrations were then varied to determine their effect on milling rate and hydrogen content as follows:

TABLE 8

| Ex. | $(NH_4)_2S_2)_8$ g/1 | Milling Rate mils/min/side | Hydrogen Content After Milling ppm |
|---|---|---|---|
| 37 | 0 | .675 | 356 |
| 38 | 0 | .725 | 404 |
| 39 | 60 | .525 | 413 |
| 40 | 120 | .525 | 406 |
| 41 | 180 | .320 | 519 |
| 42 | 240 | .200 | 45 |

Having described the presently preferred embodiments, it is to be understood that the invention may be otherwise embodied within the scope of the appended claims.

What is claimed is:

1. A substantially nitrate-free solution for milling a metal product which comprises: (a) about 5-100 g/1 of ammonium bifluoride; (b) up to about 90 g/1 of hydrochloric acid; (c) at least about 30 g/1 of a chlorate ion-containing solution; and (d) a balance of water and impurities.

2. The milling solution of claim 1 which comprises about 15-75 g/1 of ammonium bifluoride and about 8-70 g/1 of hydrochloric acid.

3. The milling solution of claim 1 which contains at least about 40-650 g/1 of sodium chlorate.

4. The milling solution of claim 1 wherein the nitrate concentration is about 1 wt.% or less.

5. The milling solution of claim 1 wherein the metal product consists essentially of a titanium alloy having one or more of the following phases: an alpha phase and a beta phase.

6. The milling solution of claim 5 wherein the alloy is selected from the group consisting of: Ti-6Al-4V, Ti-6Al-6V-2Sn, Ti-10V-2Fe-3Al and commercially pure titanium metal.

7. A substantially nitrate-free solution for milling a metal product which comprises: (a) about 5-100 g/1 of ammonium bifluoride; (b) up to about 90 g/1 of hydrochloric acid; (c) at least about 180 g/1 of a peroxysulfate ion-containing solution; and (d) a balance of water and impurities.

8. The milling solution of claim 7 which comprises about 15-75 g/1 of ammonium bifluoride, about 8-70 g/1 of hydrochloric acid and up to about 650 g/1 of the peroxysulfate ion-containing solution.

9. The milling solution of claim 8 which contains about 200-350 g/1 of ammonium peroxysulfate.

10. The milling solution of claim 7 wherein the nitrate concentration is about 1 wt.% or less.

11. The milling solution of claim 7 wherein the metal product consists essentially of a titanium alloy having one or more of the following phases: an alpha phase and a beta phase.

12. The milling solution of claim 11 wherein the alloy is selected from the group consisting of: Ti-6Al-4V, Ti-6Al-6V-2Sn, Ti-10V-2Fe-3Al and commercially pure titanium metal.

13. An aqueous solution suitable for milling a titanium product at one or more temperatures in the range of about 21°-71° C. (70°-160° F.), said solution consisting essentially of: about 15-75 g/1 of ammonium bifluoride; about 8-70 g/1 of hydrochloric acid; and a hydrogen inhibitor selected from the group consisting of about 30-650 g/1 of sodium chlorate and about 200-650 g/1 of ammonium peroxysulfate.

14. The solution of claim 13 wherein milling occurs at about 32°-57° C. (90°-135° F.).

15. The solution of claim 13 wherein the titanium product is a Ti-6Al-4V forging.

16. The solution of claim 13 which produces a post-milling hydrogen content of about 150 ppm or less.

17. A method for chemically milling a metal workpiece comprising:

(a) providing an aqueous solution consisting essentially of about 15-75 g/1 of ammonium bifluoride; about 8-70 g/1 of hydrochloric acid and a hydrogen inhibitor selected from the group consisting of about 30-650 g/1 of sodium chlorate and about 200-650 g/1 of ammonium peroxysulfate;

(b) maintaining the solution at one or more temperatures in the range of about 21°-71° C. (70°-160° F.); and (c) immersing the workpiece in the solution to mill surfaces of the workpiece in contact with the solution.

18. The method of claim 17 which further comprises one or more of the following steps before immersing step (c):

(i) cleaning the workpiece; and (ii) masking areas of the workpiece.

19. The method of claim 17 which further comprises one or both of the following steps after immersing step (c):

(d) stirring or agitating the solution with the workpiece therein; and (e) removing the workpiece from the solution and then rinsing the workpiece.

20. The method of claim 19 wherein the workpiece is a titanium alloy forging wherein said alloy is selected from the group consisting of: Ti-6Al-4V, Ti-6Al-6V-2Sn, Ti-10V-2Fe-3Al and commercially pure titanium metal.

* * * * *